299-13 3R
1/6/81 XR 4,243,100

United States Patent [19] [11] 4,243,100
Cha [45] Jan. 6, 1981

[54] OPERATION OF IN SITU OIL SHALE RETORT WITH VOID AT THE TOP

[75] Inventor: Chang Y. Cha, Bakersfield, Calif.

[73] Assignee: Occidental Oil Shale, Inc., Grand Junction, Colo.

[21] Appl. No.: 35,930

[22] Filed: May 4, 1979

[51] Int. Cl.[2] ..... E21B 43/243; E21B 43/26; E21C 41/10

[52] U.S. Cl. ..... 166/259; 166/251; 299/2; 299/13

[58] Field of Search ..... 166/259, 256, 251, 299; 299/2, 13

[56] References Cited

U.S. PATENT DOCUMENTS

| | | | |
|---|---|---|---|
| 3,001,776 | 9/1961 | Van Poollen | 299/2 |
| 3,460,620 | 8/1969 | Parker | 166/257 |
| 3,537,528 | 11/1970 | Herce | 166/259 X |
| 3,578,080 | 5/1971 | Closmann | 166/259 X |
| 3,692,110 | 9/1972 | Grady | 166/259 X |
| 3,952,801 | 4/1976 | Burton | 166/256 |
| 4,027,917 | 6/1977 | Bartel et al. | 299/2 |
| 4,043,597 | 8/1977 | French | 166/259 X |
| 4,109,719 | 8/1978 | Martin et al. | 166/259 |
| 4,118,071 | 10/1978 | Hutchins | 166/259 X |
| 4,147,389 | 4/1979 | Bartel et al. | 166/259 X |

*Primary Examiner*—Stephen J. Novosad
*Attorney, Agent, or Firm*—Christie, Parker & Hale

[57] ABSTRACT

An in situ oil shale retort is formed with an upper surface of a fragmented permeable mass in the retort separated from a top boundary of unfragmented formation, creating an inlet plenum void. A primary combustion zone is established in the fragmented mass, and such primary combustion zone is caused to spread laterally by the establishment of a secondary combustion zone. During a first period of time, the temperature in the inlet plenum void is maintained at less than the temperature at which unfragmented formation from above the top boundary will slough into the void. The primary combustion zone is advanced through the retort and liquid and gaseous products of retorting are withdrawn. During a second period of time the temperature in the inlet plenum void is increased to increase the temperature of the top boundary of unfragmented formation to a temperature which will cause unfragmented formation from above the top boundary to slough into the void. Preferably, sufficient formation is sloughed for substantially completely filling such void to provide support for overlying formation after completion of retorting.

31 Claims, 5 Drawing Figures

OPERATION OF IN SITU OIL SHALE RETORT WITH VOID AT THE TOP

BACKGROUND OF THE INVENTION

This invention relates to in situ recovery of shale oil, and more particularly, to techniques for operation of an in situ oil shale retort formed with a void between a top boundary of unfragmented formation and the fragmented permeable mass of oil shale particles in the retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen," which, upon heating, decomposes to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the change of surface contamination and the requirement for disposal of solid wastes.

The recovery of liquid and gaseous products from oil shale deposits have been described in several patents, such as U.S. Pat. Nos. 3,661,423; 4,043,595, 4,043,596; 4,043,597; and 4,043,598 which are incorporated herein by this reference. These patents describe in situ recovery of liquid and gaseous hydrocarbon materials from a substerranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated to explosively expand each unfragmented zone into the voids on either side of each unfragmented zone to form a fragmented mass having a void volume equal to the void volume of the initial voids. Retorting of the fragmented mass is then carried out to recover shale oil from the oil shale.

It is desirable to have a generally uniformly distributed void volume, or a fragmented mass of generally uniform permeability so that oxygen supplying gas can flow relatively uniformly through the fragmented mass during retorting operations. Techniques used for explosively expanding zones of unfragmented formation toward the horizontal free faces of formation adjacent the voids can control the permeability of the fragmented mass. A fragmented mass having generally uniform permeability in horizontal planes across the fragmented mass avoids bypassing portions of the fragmented mass by retorting gas as can occur if there is gas channeling through the mass owing to non-uniform permeability.

It is desirable to establish a primary combustion zone which is relatively flat and extends laterally across the entire fragmented permeable mass. The relatively flat primary combustion zone extending laterally across the entire fragmented permeable mass enables retorting of a maximum volume of fragmented permeable mass of oil shale which tends to maximize the yield of liquid and gaseous products from the in situ oil shale retort. A flat primary combustion zone extending laterally across the entire fragmented permeable mass can be created by using a burner to ignite a portion of the fragmented permeable mass and introducing a fuel and an oxygen containing gas into the retort to spread the primary combustion zone laterally.

The burner is ignited and the flame from the burner is directed downwardly toward the fragmented permeable mass to heat an upper portion of the fragmented permeable mass to greater than the self ignition temperature of carbonaceous material in the oil shale. The burner is then withdrawn from the retort and fuel and an oxygen containing gas are introduced for establishing a secondary combustion zone, thereby spreading the primary combustion zone laterally. Some difficulty has been encountered in causing a primary combustion zone to spread laterally near the top of an in situ oil shale retort where the fragmented mass completely fills the retort cavity. Thus, considerable time and fuel can be consumed in causing the combustion zone to spread laterally to a sufficient extent to recover shale oil from some of the upper portions of the fragmented mass. Previous techniques have caused the combustion zone to propagate downwardly a considerable distance as it spreads laterally, the downward and radial distance being about the same. This can cause some of the shale oil produced in the upper portions of the fragmented permeable mass to pass through downwstream portions of the primary combustion zone thereby being consumed. The consumption of shale oil or the complete bypassing of portions of the oil shale in the upper corners of the retort tends to reduce the yield of shale oil from the retorting operation. It is therefore desirable to have a technique for improving the rate and extent of lateral spreading of the combustion zone near the top of the retort.

The rate and extent of lateral spreading of the primary combustion zone can be improved by using a retort which has a void between the top boundary of unfragmented formation and the upper surface of the fragmented permeable mass. This void acts as a plenum which permits uniform gas distribution over the top of the fragmented permeable mass and enhances the lateral propagation of the combustion zone.

U.S. Pat. No. 4,027,917 issued to W. J. Bartel et al and assigned to the same assignee as the present invention, discloses a method of igniting an oil shale retort by directing a combustible gas inlet mixture into an ignition zone extending across the top of the in situ oil shale retort. Although the ignition zone has a high void volume compared to the average void volume of the retort, the ignition zone is completely filled with fragmented oil shale.

The creation of an in situ oil shale retort with a void across substantially the entire upper surface of the fragmented permeable mass between the top boundary of unfragmented formation and fragmented permeable mass can be accomplished by detonation of explosive in a time delay sequence which is designed to produce a fragmented permeable mass of generally uniform permeability.

The use of in situ oil shale retort with such a void can result in mining problems after the completion of retorting. Unless the void is substantially completely filled after the completion of the retorting, the overlying formation will remain unsupported, possibly causing the surface to subside creating safety hazards in the area. Further, where there is no direct support for overlying formation, stresses can build up in the formation surrounding the void. These stresses can cause overloading of the formation in the area of the void which can result in fracturing and/or collapse of the formation during subsequent mining operations in adjacent workings.

SUMMARY OF THE INVENTION

Liquid and gaseous products are recovered from an in situ oil shale retort in a subterranean formation containing oil shale. The retort has a top boundary of unfragmented formation and contains a fragmented permeable mass of formation particles containing oil shale. An upper surface of the fragmented permeable mass is separated from the top boundary of unfragmented formation by an inlet plenum void.

Oil shale is ignited in an upper portion of the fragmented permeable mass to establish a combustion zone and the combustion zone is thereafter spread laterally across the upper portion of the fragmented permeable mass. For a first period of time the temperature of the top boundary of unfragmented formation is maintained at less than the temperature at which unfragmented formation of the top boundary will slough into the inlet plenum void. The combustion zone is advanced downwardly through the retort and liquid and gaseous products of retorting are withdrawn from the retort. For a second period of time unfragmented formation is sloughed from above the top boundary into the inlet plenum void.

BRIEF DESCRIPTION OF THE DRAWINGS

These and other aspects of the invention will be more fully understood by referring to the following detailed description and the accompanying drawings in which.

DETAILED DESCRIPTION

The present invention provides for recovery of liquid and gaseous products by operation of an in situ retort which has been formed in a subterranean formation containing oil shale. The retort is formed with an inlet plenum void across substantially the entire fragmented permeable mass between the upper surface of the fragmented permeable mass and top boundary of unfragmented formation. The operation of the retort includes forming a primary combustion zone, establishing a secondary combustion zone for spreading the primary combustion zone laterally, advancing the primary combustion zone through the retort, recovering liquid and gaseous products of retorting, and causing sloughing of unfragmented formation to substantially fill the retort inlet plenum void. The following description is in two parts: formation of a retort and operation of a retort.

Formation of the in situ oil shale retort

Figure 1:
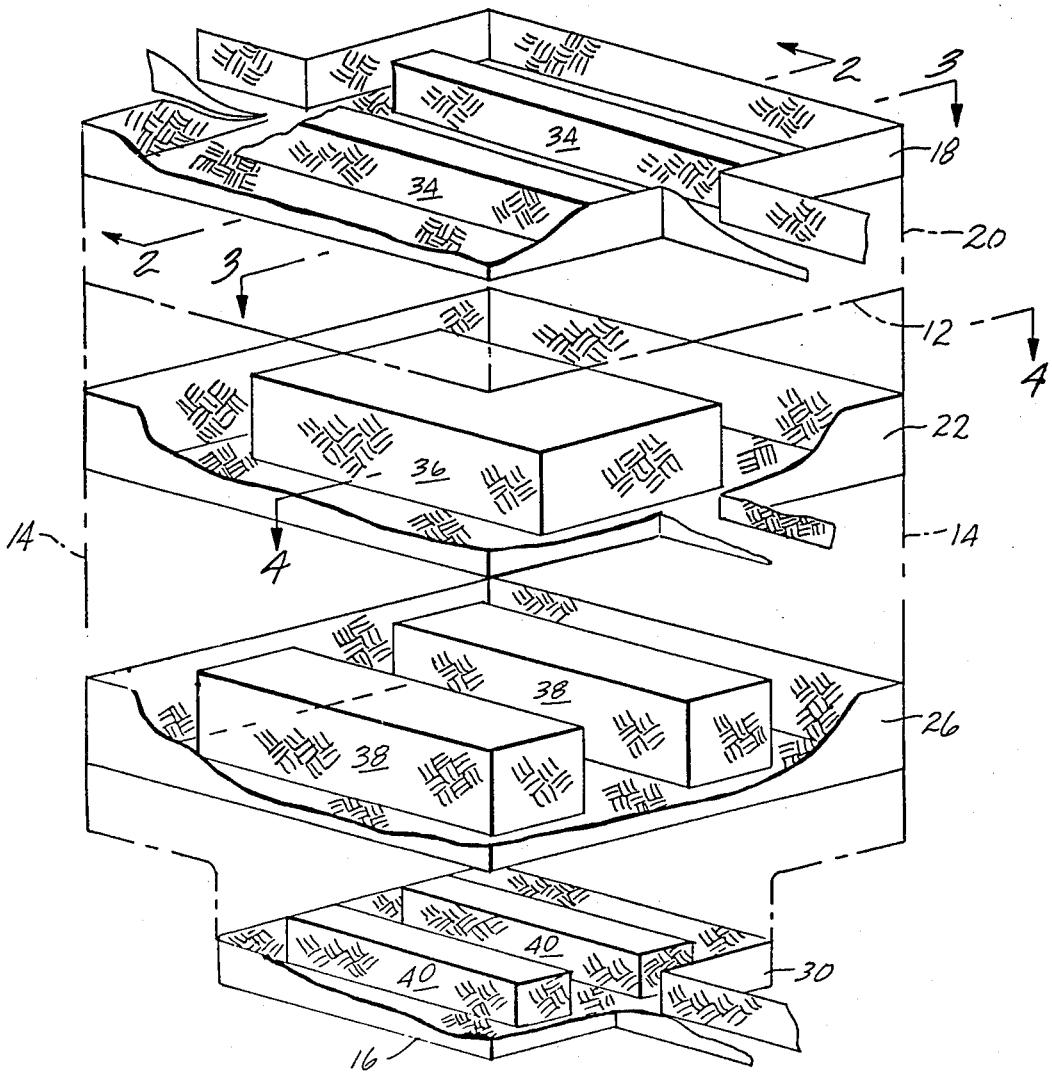
FIG. 1 is a fragmentary, semi-schematic perspective view showing a subterranean formation containing oil shale prepared for explosive expansion for forming an in situ oil shale retort.
Figure 2:
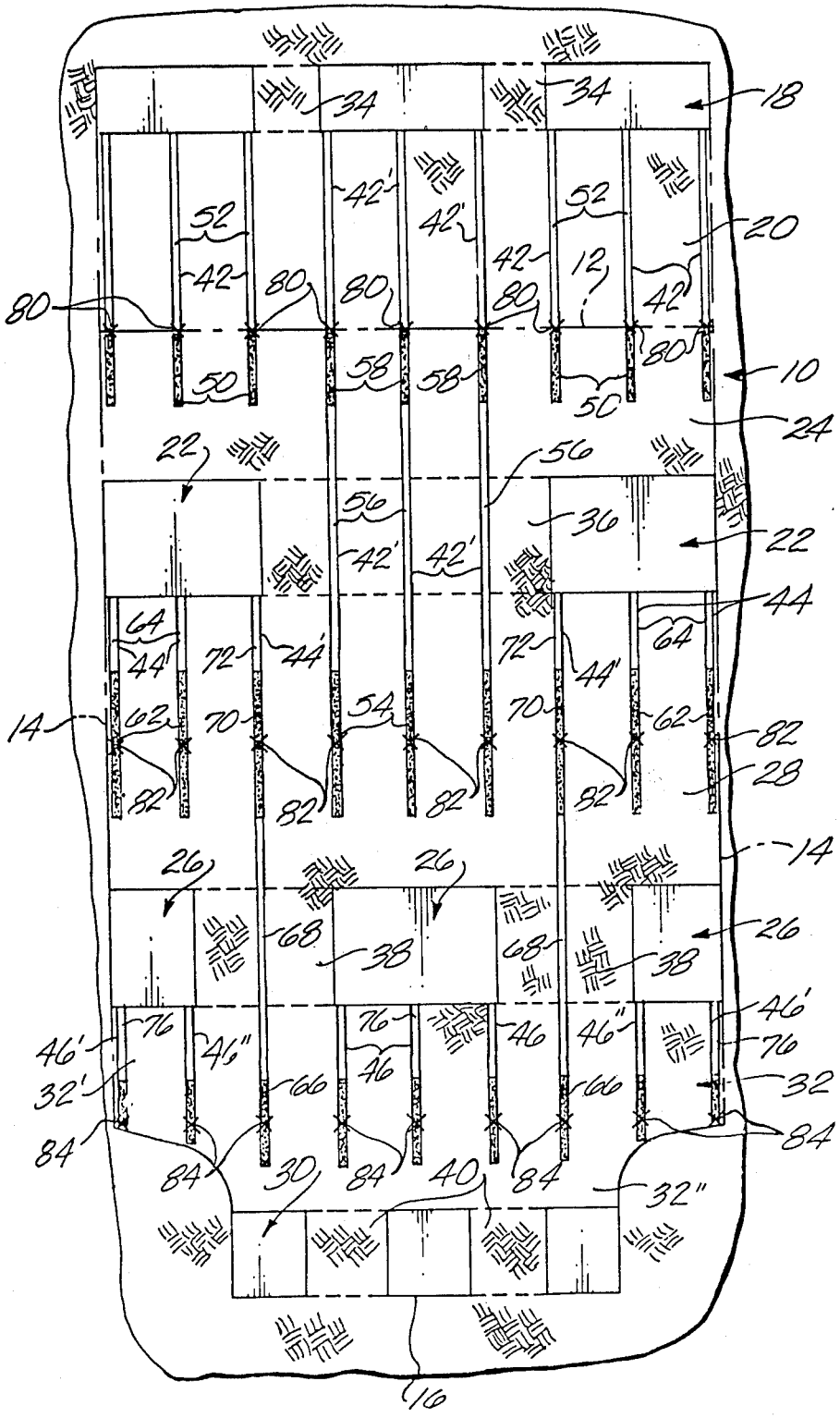
FIG. 2 is a fragmentary, semi-schematic vertical cross-sectional view taken on line 2—2 of FIG. 1.

FIGS. 1 and 2 schematically illustrate an in situ oil shale retort being formed for use in accordance with principles of this invention. As illustrated in FIGS. 1 and 2, the in situ retort is formed in a subterranean formation containing oil shale. The in situ retort shown in FIGS. 1 and 2 is rectangular in horizontal cross-section, having a top boundary 12, four vertically extending side boundaries 14, and a bottom boundary 16. Although illustrated as substantially square, the horizontal cross-section can be long and narrow if desired.

An in situ retort is formed by a horizontal free face system in which formation is excavated from within the retort site for forming a plurality of vertically spaced apart voids each extending horizontally across a different level of the retort site, leaving zones of unfragmented formation within the retort site between adjacent pairs of horizontal voids. The formation of such an in situ retort is described in application Ser. No. 929,250 filed on July 31, 1978 by Thomas E. Ricketts, titled "METHOD FOR EXPLOSIVE EXPANSION TOWARD HORIZONTAL FREE FACES FOR FORMING AN IN SITU OIL SHALE RETORT", now U.S. Pat. No. 4,192,554, and assigned to the same assignee as this application, which application is hereby incorporated herein by this reference.

For clarity of illustration, each horizontal void is illustrated in FIG. 1 as a rectangular box having an open top and a hollow interior. One or more pillars of unfragmented formation can remain within each void for providing temporary roof support. Such pillars are illustrated as rectangular boxes inside the voids illustrated in FIG. 1.

In the embodiment illustrated in FIGS. 1 and 2, a portion of the formation within the retort site is excavated on an upper working level for forming an open base of operations 18. The floor of the base of operations is spaced above the top boundary 12 of unfragmented formation of the retort being formed, leaving a horizontal sill pillar 20 of unfragmented formation between the floor of the base of operation and the top boundary of the retort being formed. The horizontal cross-sectional area of the base of operations is sufficient to provide effective access to substantially the entire horizontal cross-section of the retort being formed. The base of operations provides access for drilling and explosive loading for subsequently explosively expanding formation toward the voids formed within the retort site for forming a fragmented permeable mass of formation particles containing oil shale within the upper, side and bottom boundaries 12, 14 and 16 respectively, of the retort being formed.

In the horizontal free face system illustrated in FIGS. 1 and 2, three vertically spaced apart horizontal voids are excavated within the retort site. A rectangular upper void 22 is excavated at a level spaced vertically below the base of operations 18, leaving an upper zone 24 of unfragmented formation extending horizontally across the retort site between the top boundary 12 of the retort being formed and a horizontal upper free face above the upper void. A rectangular intermediate void 26 is excavated at an intermediate level of the retort being formed, leaving an intermediate zone 28 of unfragmented formation extending horizontally across the retort site between a horizontal lower free face below the upper void and a horizontal upper free face above the intermediate void. In the embodiment shown, the horizontal cross-sectional area within the side boundaries of the intermediate void is similar to that of the upper void and the intermediate void is directly below the upper void.

A production level void 30 is excavated at a lower production level of the retort being formed, leaving a lower zone 32 of unfragmented formation extending horizontally across the retort site between a horizontal lower free face below the inermediate void and a horizontal upper free face above the production level void.

The upper, intermediate and lower voids can occupy between about 15% and about 25% of the total volume of formation within the retort being formed. Multiple intermediate voids can be used where the height of the retort being formed is proportionately greater with respect to its width than the retort illustrated in FIGS. 1 and 2.

One or more pillars are left within each of the horizontal voids for providing temporary roof support for the zone of unfragmented formation overlying each void. Each support pillar comprises a column of unfragmented formation integral with and extending between the roof and the floor of each horizontal void. Formation can be excavated to provide pillars similar to islands in which all side walls of the pillars are spaced horizontally from corresponding side walls of formation adjacent the void; or formation can be excavated to provide pillars similar to peninsulas in which one end of the pillar is integral with a side wall of formation adjacent the void, while the remaining side walls of the pillars are spaced horizontally from the corresponding side walls of formation adjacent the void. As illustrated in FIGS. 1 and 2, the base of operations 18 includes a pair of laterally spaced apart, parallel, relatively long and narrow support pillars 34 extending most of the length of the base of operations. Each pillar 34 is similar to a peninsula, with one end of such a pillar being integral with a side wall of formation adjacent the air level base of operations 18, forming a generally E-shaped void space within the base of operations 18.

As illustrated in FIG. 1, the upper void 22 includes one large support pillar 36 of rectangular horizontal cross-section located centrally within the upper void. The pillar 36 is similar to an island, with all side walls of the pillar being spaced from corresponding side walls of formation adjacent the upper void, forming a generally rectangular peripheral void space surrounding all four side walls of the support pillar.

The intermediate void 26 includes a pair of laterally spaced apart, parallel, relatively long and narrow support pillars 38. As illustrated in FIG. 1, the support pillars in the intermediate void extend a major part of the width of the void. These pillars are similar to islands in that a void space surrounds the entire periphery of each pillar. The excavated volume of the upper void is about the same as the excavated volume of the intermediate void so that formation expanded toward such voids has the same void volume into which to expand. This promotes uniformity of void fraction distribution.

The production level void 30 includes a pair of laterally spaced apart, relatively long and narrow, parallel support pillars 40 extending a major part of the width of the production level void. The support pillars 40 are similar to peninsulas, forming a generally E-shaped void space within the lower void. The ends of the pillars in the lower void are integral with the rear wall of the lower void, as the retort is viewed in FIG. 1.

Thus, a first or upper horizontal void within the boundaries of the retort being formed provides an open floor space vertically above at least a portion of a pillar in a second or lower horizontal void immediately below the first horizontal void. The open floor space provided by the upper void directly above a portion of the pillar in the lower void provides an access region for drilling vertical blastholes from the upper void through the pillar into the zone of unfragmented formation below the pillar in the lower void. The open floor space is of sufficient width to facilitate drilling one or more vertical blastholes down from the open floor space in the upper horizontal void, through unfragmented formation below the upper void, through the second pillar, and into the zone of unfragmented formation below the second pillar.

Figure 3:
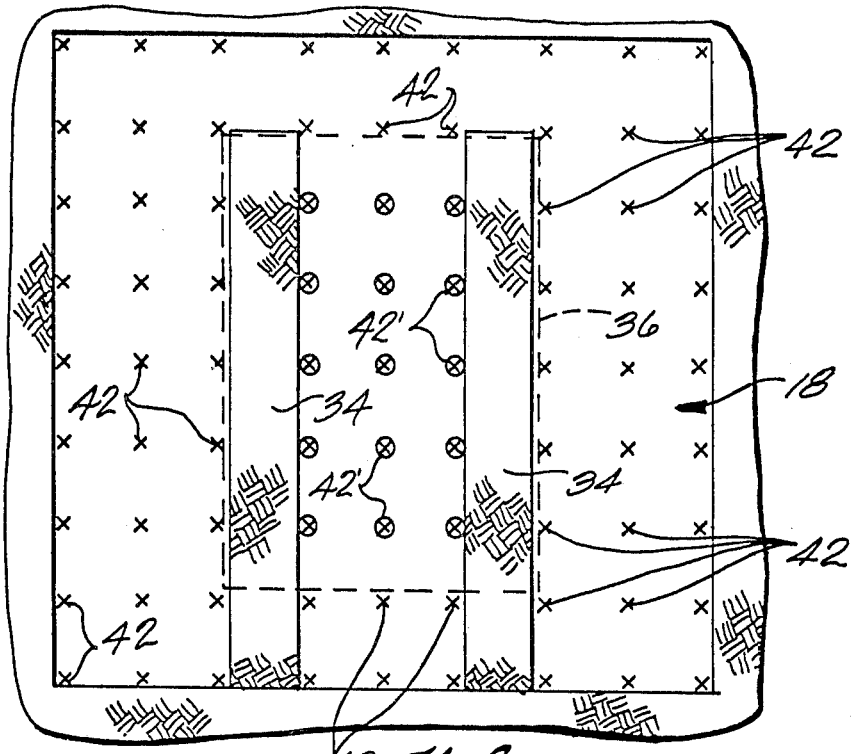
FIG. 3 is a fragmentary, semi-schematic horizontal cross-sectional horizontal view taken on line 3—3 of FIG. 1.

In the embodiment illustrated in FIG. 2, the pillars 34 in the air level base of operations 18 extend vertically above only the outer portions of the pillar 36 in the upper void 22. A central portion of the pillar 36 in the upper void 22 is located vertically below the open floor space extending between the pillars 34 in the air level base of operations 18. As best illustrated in FIG. 3, the open floor space between the pillars 34 in the air level base of operations extends for the entire length of the pillar in the upper void. Thus, at least a portion of the pillar 36 in the upper void, as well as the zone of unfragmented formation below the pillar in the upper void can be reached by vertical blastholes 42' drilled down from the floor of the base of operations, through the sill pillar 20, through the upper zone 24 of unfragmented formation, through the pillar in the upper void, and into the intermediate zone 28 of unfragmented formation below the pillar in the upper void.

Figure 4:
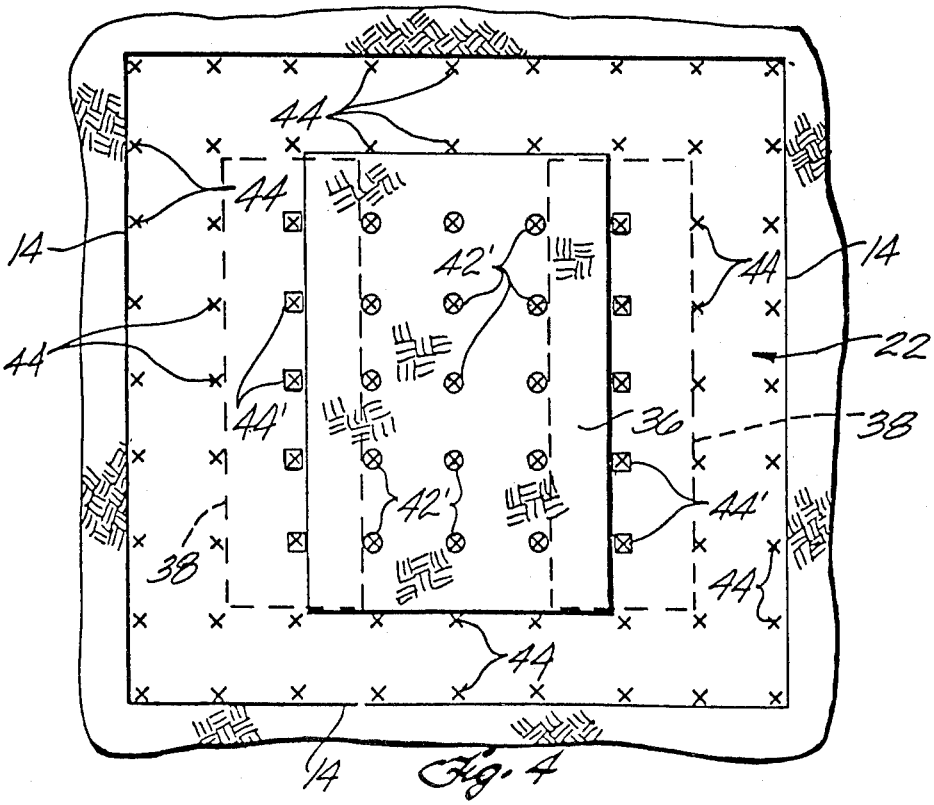
FIG. 4 is a fragmentary, semi-schematic horizontal cross-sectional view taken on line 4—4 of FIG. 1.

The pillars 38 in the intermediate void are offset horizontally relative to the pillar 36 in the upper void 22. The inside portions of the two pillars in the intermediate void are located directly below the outer portions of the pillar in the upper void, that is, there is some overlap of the upper and lower pillars. The outer portions of the pillars in the intermediate void are located vertically below an open floor space adjacent opposite side walls of the pillar in the upper void. As best illustrated in FIG. 4, at least a portion of the entire length of each pillar 38 in the intermediate void is accessible from an open floor space in the upper void. Thus, the zone of unfragmented formation below each pillar in the intermediate void can be reached by vertical blastholes 44' drilled down from the floor of the upper void, through the intermediate zone 28 of unfragmented formation, through a pillar 38 in the intermediate void, and into the lower zone 32 of unfragmented formation below such a pillar.

The support pillars 40 in the production level void 30 are shown in FIG. 2 as being offset horizontally relative to corresponding pillars 38 in the intermediate void. The pillars in the production level void need not be offset horizontally from the pillars in the intermediate void, inasmuch as access is not required for drilling blastholes into zones of unfragmented formation below the pillars in the production level void. The production level pillars can be offset if desired to permit vertical blasthole drilling into such pillars so that the pillars can be fragmented by explosive in such vertical blastholes.

Referring to the embodiment illustrated in FIG. 2, a plurality of mutually spaced apart vertical upper blastholes 42 are drilled down from the base of operations through the sill pillar 20 and into at least an upper portion of the upper zone 24 of unfragmented formation above the upper void 22. The upper blastholes 42 are substantially equidistantly spaced apart in each of a plurality of rows extending across the width of the base of operations. The rows of upper blastholes are parallel to one another and the rows are substantially equidistantly spaced apart from one another from the front to the rear of the air level void base of operations 18, the spacing between rows being the same as the spacing between blastholes in each row. The upper blastholes within each row are aligned with corresponding upper blastholes in adjacent rows to form a symmetrical pattern comprising a square matrix or array of blastholes across the floor of the base of operations.

In the embodiment illustrated herein, the drilling pattern for the upper blastholes is illustrated by x's shown at 42 in FIG. 3. A portion of the upper blastholes in the three centrally located rows are drilled down from an access region of the base of operations directly above the support pillar 36 in the upper void, and these fifteen upper blastholes (identified by reference numeral 42' and a circle surrounding an x in FIGS. 3 and 4) are longer than the remaining shorter upper blastholes 42 which are drilled down from the base of operations into unfragmented formation above the portion of the upper void not occupied by the support pillar 36. In the embodiment shown, the fifteen longer upper blastholes 42' are drilled down from the floor space between the two support pillars 34 within the air level void. These longer upper blastholes are drilled through the sill pillar, through the upper zone of unfragmented formation, through the pillar 36 in the upper void, and through about three-fourths of the depth of the intermediate zone 28 of unfragmented formation. The remaining shorter upper blastholes 42 are drilled down from the air level void through the entire depth of the sill pillar and through about the upper half of the upper zone 24 of unfragmented formation.

In the same embodiment, a plurality of mutually spaced apart vertical intermediate blastholes 44 are drilled down from the floor of the upper void 22 into at least a portion of the intermediate zone 28 of unfragmented formation below the upper void 22. The intermediate blastholes are drilled in a symmetrical pattern in which they are substantially equidistantly spaced apart across the width of the upper void in parallel rows which are equidistantly spaced apart from one another by the same distance to form a square matrix of blastholes similar to the upper blastholes in the base of operation. Each intermediate blasthole is drilled vertically below a corresponding upper blasthole. The desired pattern of drilling the intermediate blastholes is illustrated by x's shown at 44 in FIG. 4. A portion of the intermediate blastholes are drilled through the support pillars 38 in the intermediate void, and these ten intermediate blastholes (identified by reference numeral 44' and by a square surrounding each x in FIG. 4) are longer than the remaining shorter intermediate blastholes 44. Each of the ten longer intermediate blastholes is drilled down from a floor space in the upper void immediately adjacent a corresponding outside wall of the support pillar 36 in the upper void. These ten longer intermediate blastholes are drilled down from the upper void, through the entire depth of the intermediate zone 28 of unfragmented formation, approximately through the center of the support pillars 38 in the intermediate void, and through about three-fourths the depth of the lower zone 32 of unfragmented formation below the intermediate void. In the same embodiment, the remaining shorter intermediate blastholes extend through about three-fourths the depth of the intermediate zone 28 of unfragmented formation.

A plurality of mutually spaced apart vertical lower blastholes 46 are drilled down from the floor of the intermediate void into a portion of the lower zone 32 of unfragmented formation below the intermediate void. The lower blastholes are drilled on a symmetrical pattern in which they are substantially equidistantly spaced apart across the width of the intermediate void in parallel rows which are also equidistantly spaced apart by the same distance, forming a square matrix or array of blastholes similar to the square patterns of the upper and intermediate blastholes.

In an embodiment having a plurality of horizontal voids within a retort site wherein formation is explosively expanded upwardly and downwardly toward each horizontal void, substantially the same amount of formation is explosively expanded toward each void.

Blasting toward each horizontal void is provided by explosively expanding a zone of formation upwardly and downwardly toward each void across the entire width of such a void. Placement of explosive charges in the blast holes is best understood with reference to FIG. 2. To more clearly illustrate placement of explosive and stemming in the blastholes, the blastholes are shown out of proportion in FIG. 2, i.e., the diameter of the blastholes is actually much smaller in relation to the horizontal dimensions of the retort than is shown in FIG. 2. In a working embodiment the entire upper zone 24 of unfragmented formation is explosively expanded downwardly toward the upper void 22 and approximately the upper half of the intermediate zone 28 of formation below the floor of the upper void is expanded upwardly, after a time delay, toward the upper void. Similarly, approximately the lower half of the intermediate zone of unfragmented formation above the roof of the intermediate void 26 is explosively expanded downwardly toward the intermediate void while the upper portion 32' of the lower zone of unfragmented formation is simultaneously explosively expanded upwardly toward the intermediate void. The lower portion 32'' of the lower zone of unfragmented formation is explosively expanded downwardly toward the lower production level void 30.

In the working embodiment, approximately the lower half of each of the short upper blastholes 42 is loaded with explosive 50 up to the top boundary 12 of unfragmented formation, and the top portions 52 of the short upper blastholes are stemmed with an inert material such as sand or gravel. Thus, the columns of explosive in the short upper blastholes extend through approximately the upper half of the upper zone 24 of unfragmented formation.

The long upper blastholes 42' are drilled about three-fourths of the way through the intermediate zone 28 of unfragmented formation and a bottom portion of these blastholes is loaded with explosive 54. Thus, the lower columns of explosive in these blastholes extend through the middle half of the intermediate zone of unfragmented formation. The intermediate portion 56 of each of these blastholes extends through approximately half of the intermediate zone of unfragmented formation, through the support pillar 36 in the upper void, and through approximately the bottom half of the upper zone of unfragmented formation. This intermediate portion 56 of each of the blastholes is stemmed. A separate upper column 58 of explosive is loaded above the stemming in each of the intermediate portions of these blastholes. These upper columns of explosive extend through the upper half of the upper zone of unfragmented formation, i.e., for approximately the same depth as the explosive columns 50 in the short upper blastholes 42. The remaining upper portions 60 of the long upper blastholes 42', i.e., the portions which extend through the sill pillar, are stemmed.

The short intermediate blastholes 44 are drilled down from the upper void 22 about three-fourths of the way to the intermediate void, and approximately the bottom two-thirds of these blastholes are loaded with explosive 62. The remaining upper portions 64 of these blastholes extend through approximately the top one-fourth of the intermediate zone of unfragmented formation, and this portion of each of the short intermediate blastholes is stemmed. Thus, the columns of explosive in the short intermediate blastholes extend through approximately the middle half of the intermediate zone of unfragmented formation. These columns of explosive correspond to the lower columns 54 of explosive in the longer blastholes drilled from the base of operations through the pillar 36 and into the intermediate zone of unfragmented formation.

The long intermediate blastholes 44' are drilled down from the upper void to a level below the floor of the intermediate void, and the lower portion of each of these blastholes is loaded with explosive 66. Thus, the lower columns of explosive extend through approximately the lower half of the upper portion 32' of the lower zone which is explosively expanded upwardly toward the intermediate void plus the upper half of the lower portions 32'' of the lower zone which is explosively expanded downwardly toward the production level void. Intermediate portions 68 of these blastholes extend through approximately the upper half of the lower zone of unfragmented formation, through the entire depth of a corresponding pillar 38 in the intermediate void, and through approximately the lower half of the intermediate zone of unfragmented formation. This intermediate portion 68 of each of the long intermediate blastholes is stemmed. An upper column 70 of explosive is loaded into each of these blastholes, and the upper portion 72 of each of these blastholes is stemmed. Thus, the upper columns of explosive 70 extend through approximately the middle half of the intermediate zone of unfragmented formation. The bottom portions of the lower blastholes 46 are loaded with explosive and the upper portions 76 of all the lower blastholes are stemmed.

Detonation of each explosive charge is initiated remote from the end of the column of explosive nearest the free face toward which formation is explosively expanded when the explosive is detonated. When so detonated the direction of propagation of detonation through explosive is toward the free face. In the working embodiment, separate detonators (represented by an x at 80 in FIG. 2) are placed above the columns of explosive 50 and 58 in the blast holes in the upper zone of unfragmented formation. Thus, each of these detonators is at the same level, namely, at the top of the upper zone of unfragmented formation. Detonation of explosive in the upper blast holes is initiated such that the direction of propagation of detonation is toward the upper free face adjacent the upper void.

In the intermediate zone of unfragmented formation, a detonator or a plurality of detonators for redundancy, (represented by an x at 82 in FIG. 2) is placed in the center of each column of explosive for initiating detonation of such explosive upwardly toward the upper void and downwardly toward the lower void. These detonators are positioned at a level approximately mid-way between the lower free face of formation adjacent the upper void and the upper free face of formation adjacent the lower void. Detonation is initiated in the middle of the intermediate zone so that detonation propagates toward each of the two adjacent free faces, and such initiation results in a better cratering effect than initiation at other points within the intermediate zone.

Separate detonators (represented by an x at 84 in FIG. 2) are placed at about the same level in each of the columns of explosive in the lower zone of unfragmented formation, namely, about between the intermediate void and the production level void. Detonation of explosive in the lower blasthole is initiated such that the direction of propagation of detonation is upwardly toward the lower free face adjacent the intermediate void. Detonation of the portions of the lower blastholes above the production level void propagates toward the free face at the roof of the production level void for explosive expansion of formation within the lower portion 32″ of the lower zone toward the production level void.

Explosive is also placed in the support pillars in the upper, intermediate and lower voids. Horizontally extending blastholes (not shown) can be drilled in the pillars and such blastholes are loaded with explosive in preparation for explosively expanding the pillars. A variety of arrangements of horizontal blastholes can be used depending on the size and shape of the pillars. Alternatively, the vertical blastholes drilled through the pillars can be loaded with explosive charges. Sufficient explosive is placed in the pillars to explosively expand the entire unfragmented mass of each pillar toward its respective void.

Figure 5:
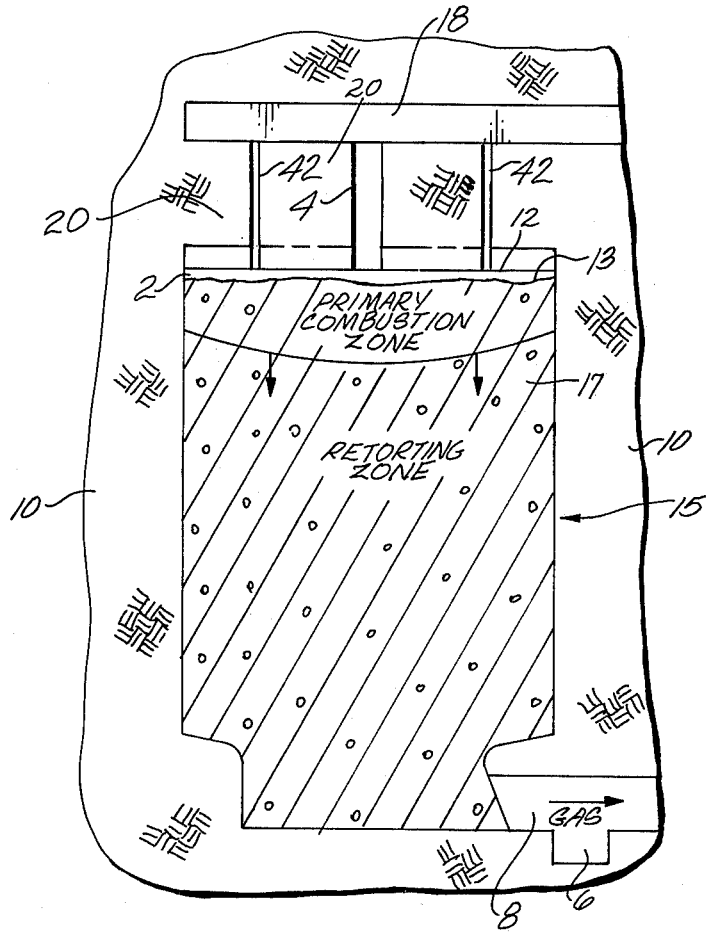
FIG. 5 is a fragmentary, semi-schematic vertical cross-sectional view of a completed in situ oil shale retort formed for operation according to principles of this invention.

The technique for creating an inlet plenum void above the fragmented mass in the retort involves detonating the explosive in the upper zone 24 of unfragmented formation above the upper void 22 a short time before detonating the explosive in intermediate zone 28 of unfragmented formation below the upper void so that the unfragmented formation above the upper void is expanded a greater amount and for a longer time than the unfragmented formation below the upper void. Formation from the upper zone 24 does not bulk or expand enough to fill the available space and leaves an open inlet plenum void 2 as illustrated in FIG. 5.

The retort containing the fragmented permeable mass and inlet plenum void 2 can be created using a carefully coordinated sequence of blasting events beginning with the destruction of the pillars. All detonators in the upper, intermediate and lower blastholes are initiated before the pillars are explosively expanded to insure that there are no detonating cord or electrical line cutoffs caused by the explosive expansion of the pillars.

Non-electric downhole delay blasting caps are used for the upper, intermediate and lower columns of explosive. These caps are initiated downhole before any explosive expansion of the pillars takes place. Fragmented mass ejected from the pillars by the detonation moves at a velocity of about 100 feet per second, or one foot every 10 milliseconds. The explosive expansion of the upper, intermediate and lower zones of unfragmented formation can be delayed for a short period of time to let the fragmented mass ejected by explosive expansion of the pillars disperse before detonation of the explosive charges in the remainder of unfragmented formation.

In an exemplary embodiment the explosive in the pillars is initially detonated. After a time interval of about 50 to 150 milliseconds, the explosive charges in the upper zone 24 of unfragmented formation are detonated and after an additional 50 to 150 milliseconds, the explosive below the upper void 22 is detonated. Additional time is allowed for expansion of the upper zone 24 of unfragmented formation as compared with the time allowed for expansion of unfragmented formation below the upper void 22. The additional time is allowed for expansion of unfragmented formation of the upper zone 24 so that such unfragmented formation expands a greater distance than the unfragmented formation below the upper zone. The formation from the upper zone does not bulk enough to fill the available space thereby forming an empty volume in the retort below the top boundary 12 of unfragmented formation. Herein such empty volume is termed the "retort inlet plenum void" 2. It is preferred that substantially the entire upper surface 13 of the fragmented permeable mass is separated from the top boundary of unfragmented formation by the inlet plenum void. The unfragmented formation between the top boundary 12 of unfragmented formation and the base of operations 18 is termed the "sill pillar" 20.

The inlet plenum void, however, is not necessarily uniform and the void may be higher in some locations than others. For example, a portion of the upper surface of the fragmented permeable mass of formation particles in some locations can touch the top boundary of unfragmented formation.

FIG. 5 illustrates an in situ oil shale retort 15 which has been formed containing a fragmented permeable mass 17 of formation particles containing oil shale, and having an inlet plenum void 2 between the upper surface 13 of the fragmented permeable mass and the top boundary 12 of unfragmented formation.

Further steps are employed to prepare the retort for the retorting operation, such steps include drilling a gas inlet passage 4 downwardly from the base of operations 18 through the bottom of the sill pillar 20, so that an oxygen supplying gas can be introduced into the retort during the retorting operation. Alternatively at least a portion of the upper blastholes through the sill pillar 20 can be used for introduction of the oxygen supplying gas. A separate horizontally extending product withdrawal drift 8 is also formed, such product withdrawal drift extending away from a lower portion of the unfragmented permeable mass at a lower level of the retort, for removal of liquid and gaseous products from retorting.

Operation of the in situ oil shale retort

During an ignition period preceding retorting operations, a primary combustion zone and a retorting zone are established near the upper surface 13 of the fragmented permeable mass. A retort inlet mixture comprising fuel and at least sufficient oxygen for combustion of the fuel is introduced into the retort for establishing a secondary combustion zone, thereby increasing the rate of lateral spreading of the primary combustion zone across the fragmented permeable mass. During a first period of time the temperature of the top boundary 12 of unfragmented formation above the inlet plenum void is maintained sufficiently low to avoid thermal sloughing. After the ignition period, the fuel can be discontinued while continuing the introduction of oxygen supplying gas for sustaining and advancing the primary combustion zone downwardly through the fragmented permeable mass. Liquid and gaseous products of retorting are withdrawn from the lower portion of the fragmented permeable mass on the advancing side of the retorting zone. For a second period of time, such period of time preferably being after completion of retorting operations, the temperature within the inlet plenum void 2 is substantially increased. The increase of the temperature in the inlet plenum void 2 causes the temperature of the top boundary 12 of unfragmented formation to increase to a temperature which causes thermal sloughing of overlying unfragmented formation into the inlet plenum void 2 thereby providing mechanical support for the overlying formation.

As used herein, the term "primary combustion zone" refers to a portion of the retort where the greater part of the oxygen in the retort inlet mixture that reacts with the residual carbonaceous material in the retorted oil shale is consumed. As used herein, the term "retorting zone" refers to the portion of the retort where kerogen in oil shale is being decomposed to liquid and gaseous products. As used herein, the term "secondary combustion zone" refers to that portion of the retort where fuel in a retort inlet mixture is consumed. As used herein, the term "oxygen supplying gas" refers to oxygen; air enriched with oxygen; an air and fuel mixture; air mixed with a diluent such as nitrogen, off gas from an in situ oil shale retort, or steam; and mixtures thereof.

To establish a primary combustion zone near the upper surface 13 of the fragmented permeable mass near the bottom of the gas inlet 4, carbonaceous material in the oil shale is ignited by any known method as for example the methods described in U.S. Pat. No. 3,952,801 or U.S. Pat. No. 3,661,423, both of which are incorporated herein by this reference. U.S. Pat. No. 3,952,801, for example, describes a technique whereby a gas-air burner is lowered into a gas inlet passage. Fuel and an oxygen containing gas are introduced to the burner, the gas mixture ignited, and the flame directed downwardly toward the top of the fragmented permeable mass, heating an upper portion of the fragmented permeable mass to above the self-ignition temperature of oil shale.

The burner can be used for a day or two to heat a portion of the fragmented permeable mass to above the self-ignition temperature of carbonaceous material in oil shale. The burner is removed and a retort inlet mixture containing fuel and an oxygen supplying gas having at least sufficient oxygen for combustion of the fuel is introduced through the gas inlet 4. The retort inlet mixture has a spontaneous ignition temperature less than the temperature within a top portion of the fragmented permeable mass which has been heated by the burner. The fuel to oxygen ratio of the retort inlet mixture is adjusted for providing a secondary combustion zone in an upper portion of the fragmented permeable mass below the upper surface 13 of such fragmented permeable mass. Thus, there is first localized ignition with hot gas from the burner, followed by lateral propagation of the combustion zone by use of a secondary combustion zone. Such localized ignition keeps the area of overlying formation exposed to high temperature reasonably small for eliminating or minimizing thermal sloughing into the inlet plenum void.

The inlet plenum void 2 enhances uniform gas distribution and enables gas to spread rapidly through the upper portion near the upper surface of the fragmented permeable mass. The secondary combustion zone therefore propagates laterally more rapidly than if the fragmented permeable mass were in tight engagement with the top boundary 12 of unfragmented formation. To at least some extent, the rate of the lateral spreading of the primary combustion zone is further enhanced by the elevated temperature in the secondary combustion zone. Such elevated temperatures reduce the mass flow rate of gas through the secondary combustion zone, and promote increased mass flow rate of gas in cooler regions. This occurs for several reasons, including reduction of void fraction in the heated portion of the fragmented mass due to thermal expansion of the particles, increased gas viscosity, and increased volumetric flow rate due to gas expansion. Pressure drop, however, is the same both across the region heated by the secondary combustion zone and across the adjacent cooler regions. Since the pressure drop is similar, the effective volumetric flow rate must be similar. Thermal expansion of the gas causes the mass flow rate to be lower in the high temperature regions for similar volumetric flow rate. This reduction in mass flow rate of gas through the secondary combustion zone and increase in mass flow rate of gas in the cooler regions, increases the rate of lateral spreading of the primary combustion zone and decreases its rate of downward advance.

An inlet plenum void 2 of approximately one foot in height across the entire fragmented permeable mass is considered sufficient for distribution of gas for enhancing the propagation of the combustion zone laterally. Preferably, the void is only large enough to allow rapid spreading of the retort inlet mixture thereby increasing the rate of lateral spreading of the primary and secondary combustion zones. The size of the void appears to be optimized when the inlet plenum void is about one foot in height. Increasing the height above about one foot makes it more time consuming and therefore more costly to substantially completely fill the void by later thermal sloughing without enhancing lateral spreading of the combustion zones. Heat losses can also be minimized by keeping the void short in height. A small inlet plenum void also minimizes the amount of formation excavated from the voids towards which formation is expanded for forming the fragmented mass in the retort.

The retort inlet plenum void enables the rate of lateral propagation of the primary combustion zone to be increased, but can also create a problem because the sill pillar is unsupported leaving a potential for the formation from above the upper boundary of the fragmented mass to slough into the void. The sloughing of formation into the void reduces the thickness of the sill pillar 20 thereby weakening or otherwise jeopardizing the integrity of such sill pillar. Sloughing unfragmented formation is enhanced by heating such formation, for example, by heat from hot gases in the fragmented mass passing into the inlet plenum void or by heat radiated from the upper surface 13 of the fragmented mass into such inlet plenum void. Cracking or other structural failure of the sill pillar could make the base of operations 18 unsafe for full utilization during retorting. In an embodiment without a sill pillar, thermal sloughing can increase the time and fuel requirements for ignition and is preferably avoided. Therefore, for a first period of time, i.e., when establishing a combustion zone and retorting oil shale in the fragmented mass, it is important to maintain the temperature of the portion of the top boundary 12 of unfragmented formation above the retort inlet plenum void below the temperature at which unfragmented formation of the top boundary would slough into such retort inlet plenum void. The temperature where thermal sloughing of oil shale can become significant appears to be approximately 400° F.

Retorting of oil shale is carried out with temperatures in excess of 400° F., for example, the minimum primary combustion zone temperature is in excess of about 800° F. However, in order to retort at an economically fast rate, it is preferred to maintain the primary combustion zone above about 900° F. Preferably, the primary combustion zone is maintained at a temperature of at least about 1150° F. for reaction between water vapor and carbonaceous residue in retorted oil shale according to the water gas reaction.

The upper limit on the temperature of the primary combustion zone is determined by the fusion temperature of oil shale which is about 2100° F. The temperature in the primary combustion zone preferably is maintained below about 1800° F. to provide a margin of safety between the temperature of the primary combustion zone and the fusion temperature of the oil shale.

The temperature of the top boundary 12 of unfragmented formation can be maintained for a first period of time below approximately 400° F., for example, by introducing the inlet mixture containing fuel and oxygen supplying gas at a sufficient rate and at a fuel to oxygen ratio to keep both the primary and secondary combustion zones below the upper surface 13 of the fragmented mass. Maintaining the combustion zones below the upper surface of the fragmented mass substantially eliminates the passing of hot gases from the fragmented mass into the inlet plenum void and produces only minimal radiation of heat from the upper surface 13 of the fragmented mass into such inlet plenum void. Maintaining the combustion zone below the upper surface of the fragmented permeable mass can, therefore, cause the temperature in the inlet plenum void to remain less than the temperature at which unfragmented formation from above the top boundary 12 will slough into such inlet plenum void.

Other methods can also be used to maintain the temperature of the retort inlet plenum void at less than the temperature required to cause sloughing of the sill pillar, for example, the methods described in application Ser. No. 868,924 entitled "METHOD FOR IGNITING AN IN SITU OIL SHALE RETORT HAVING A POCKET AT THE TOP" filed by me on Jan. 12, 1978, now U.S. Pat. No. 4,162,706, which is incorporated herein by this reference.

One such method is to introduce into the retort inlet plenum void a fluid having a temperature less than the temperature at which unfragmented formation of the bottom of the sill pillar would slough into the inlet plenum void, i.e., the temperature of fluid introduced into the inlet plenum void is less than about 400° F. The temperature of the fluid can be about ambient temperature such as when air or water is introduced to the retort inlet plenum void. The flow of fluid introduced to the retort inlet plenum void is maintained at a sufficient rate and pressure to keep the combustion zone below the surface of the fragmented mass. Thus, the combustion zone is kept spaced apart from the retort inlet plenum void by a barrier of cool fluid introduced to the retort in the plenum void. The barrier of cool fluid inhibits hot gas from the fragmented mass from entering the void and also cools the upper surface of the fragmented mass thereby reducing radiation from such fragmented mass into the void.

The cooling fluid, for example, can be a mixture of liquefied petroleum gas (LPG) and air at a fuel to oxygen ratio for combustion of the mixture below the upper surface of the fragmented permeable mass. The mixture can be added at a flow rate sufficient to carry the heat generated by the secondary combustion zone down through the retort, thereby preventing the heat from being carried by convection upstream into the inlet plenum void.

The secondary combustion zone that has been established and maintained below the upper surface 13 of the fragmented permeable mass spreads laterally across the entire fragmented permeable mass below the inlet plenum void thereby spreading the primary combustion zone laterally. The spread of the primary combustion zone is caused by the secondary combustion zone heating the oil shale to a temperature greater than the self ignition temperature of carbonaceous material in such oil shale. Excess oxygen above that used for burning fuel in the secondary combustion zone supports combustion in the primary combustion zone.

After the primary combustion zone has been spread laterally to the desired extent, fuel is discontinued to the secondary combustion zone while continuing the introduction of oxygen supplying gas through the gas inlet 4. The extent of lateral spreading of the primary combustion zone can be determined by monitoring the temperature across the fragmented permeable mass with thermocouples, or by use of other temperature monitoring means. In addition, the extent of lateral spreading of the primary combustion zone can be determined by monitoring the methane and oxygen content of the off gas from the retorting operation. When a combustion zone does not extend completely across the fragmented permeable mass to the outer boundary of unfragmented formation, a portion of the retort inlet mixture can pass through the retort without passing through a combustion zone. The oxygen in this portion of the retort inlet mixture will therefore not be completely depleted, and the percentage of oxygen in the retort off gas can be evaluated for determination of the proportion of the inlet mixture bypassing the combustion zone. As the primary combustion zone is spread laterally across the fragmented permeable mass by the secondary combustion zone, the portion of the retort inlet mixture which bypasses the primary combustion zone progressively decreases, thereby progressively decreasing the percentage of oxygen in the retort off gas. Once the primary combustion zone is spread laterally across the entire fragmented permeable mass, the entire retort inlet mixture passes through the primary combustion zone, thereby substantially completely depleting the oxygen in the retort inlet mixture. Methane is a product of retorting and helps indicate when a suitable hot zone has been established in the retort. Lack of methane in the off gas indicates insufficient retorting and the secondary combustion zone should be continued. The amount of methane is at least partly determined by the kerogen content of oil shale in the ignition region. For example, satisfactory completion of the ignition process can be indicated when the methane concentration in the off gas reaches about 0.3%. Satisfactory spreading of the primary combustion zone is indicated when the percentage of oxygen in the off gas is less than about 0.8%. The measurement of oxygen in the retort off gas during the retorting operations can therefore be used to determine when the desired extent of lateral spreading of the primary combustion zone has been achieved. Thereafter, the secondary combustion zone can be extinguished and the primary combustion zone is sustained and caused to move downwardly through the retort by the continued introduction of the oxygen supplying gas. If desired, a secondary combustion zone can be maintained after the ignition phase for enhancing yield from the retort.

A hot combustion gas is produced in the primary combustion zone. The combustion gas and any unreacted portion of the retort inlet mixture pass from the advancing side of the primary combustion zone downwardly through a retorting zone in which gaseous and liquid products are produced by retorting oil shale. The liquid and gaseous products produced in the retorting zone flow downwardly through the fragmented permeable mass of oil shale particles on the advancing side of the retorting zone into the product withdrawal drift 8 in communication with the bottom of the retort. The product withdrawal drift 8 contains a sump 6 in which liquid products including shale oil and water are collected and from which liquid products are withdrawn by conduit means. A retort off gas containing gaseous products, combustion gas, carbon dioxide from carbonate decomposition, and any gaseous unreacted portion of the retort inlet mixture is also withdrawn by way of the product withdrawal drift 8.

Retorting is continued and liquid and gaseous products of retorting are withdrawn from near the bottom of the retort through the product withdrawal drift during this retorting operation.

The presence of the inlet plenum void between the upper surface 13 of the fragmented permeable mass and the top boundary 12 of unfragmented formation eliminates mechanical support directly below the sillar pillar. It is desirable to substantially completely fill the retort with fragmented permeable mass to provide mechanical support for overlying formation. Filling the retort can be accomplished during a second period of time by sloughing unfragmented formation from above the top boundary 12 into the inlet plenum void substantially filling the inlet plenum void with fragmented mass. The second period of time can be either during retorting, e.g., after the combustion zone has moved an appreciable distance below the upper surface of the fragmented mass, i.e., about 50 feet or more, or after completion of the retorting operation.

It is preferred that the sloughing of unfragmented formation be caused by increasing the temperature of such unfragmented formation to above the temperature at which thermal sloughing will occur.

Alternatively, sloughing of the unfragmented formation from above the top boundary 12 of the unfragmented formation can be accomplished by explosive expansion of such zone of unfragmented formation toward the inlet plenum void.

Because the bulking factor for thermally sloughed oil shale is about 35%, about 3 feet of sloughing from the overlying formation is enough to fill an inlet plenum void about one foot high and the space originally occupied by the unfragmented formation of the sill pillar, thereby providing support by the fragmented mass for the overlying formation. Preferably the retort inlet plenum void is not so large that sloughing of the unfragmented formation can propagate upwardly endangering overlying workings or lead to subsidance.

Preferably, the temperature within the inlet plenum void can be increased during the second period of time by establishing a combustion zone at the upper surface of the fragmented permeable mass. The combustion zone can be established by adding fuel to the oxygen supplying gas being introduced into the retort through the gas inlet 4 and such fuel ignited. The rate of supply of fuel and oxygen supplying gas can be adjusted to produce termperatures above 400° F. in the inlet plenum void thereby heating the unfragmented formation above such inlet plenum void to greater than 400° F.

The temperature within the inlet plenum void can also be increased during the second period of time by reversing gas flow through the retort where the gas passing upwardly through the retort heats the top boundary of unfragmented formation at the bottom of the sill pillar to temperatures in excess of about 400° F. Reversing the gas flow, where such gas comprises an oxygen supplying gas, causes hot gases formed during the combustion process in the lower portions of the retort to pass upwardly through the fragmented permeable mass and into the retort inlet plenum void 2. These hot gases heat the top boundary 12 of unfragmented formation to above 400° F. thereby causing sloughing of overlying formation into the inlet plenum void.

The hot gases introduced into the lower portions of the retort can be recovered after passing upwardly through the fragmented permeable mass and through the gas inlet 4 or through the upper blastholes 42 by routine methods using conventional surface equipment.

A method of increasing the temperature above a void by reversing gas flow in an oil shale retort to cause sloughing of overlying formation is illustrated in U.S. Pat. No. 3,460,620 to Parker and is incorporated herein by this reference.

Although this invention has been described in considerable detail with reference to certain versions thereof, other versions are within the scope of this invention. For example, although the drawings show a retort where there is a sill pillar above the fragmented mass, this invention is also useful for retorts not having a sill pillar, that is, where overlying unfragmented formation extends to the ground surface. Because of variations such as this, the spirit and scope of the appended claims should not necessarily be limited to the description of the preferred versions contained therein.

What is claimed is:

1. A method for recovering liquid and gaseous products from an in situ oil shale retort in a subterranean formation containing oil shale, the retort having a top boundary of unfragmented formation and containing a fragmented permeable mass of formation particles containing oil shale wherein substantially all of the upper surface of the fragmented permeable mass is separated from the top boundary of unfragmented formation by an inlet plenum void, the method comprising the steps of:

igniting oil shale in an upper portion of the fragmented permeable mass to establish a primary combustion zone;

spreading the primary combustion zone laterally across the upper portion of the fragmented permeable mass;

for a first period of time maintaining a temperature in the inlet plenum void at less than the temperature at which unfragmented formation from above the top boundary will slough into the inlet plenum void;

advancing the primary combustion zone downwardly through the retort;

withdrawing liquid and gaseous products of retorting from the retort; and for a second period of time causing sloughing of unfragmented formation from above the top boundary into the inlet plenum void for substantially filling the inlet plenum void with fragmented mass.

2. The method according to claim 1 wherein a retort inlet mixture is introduced for spreading the primary combustion zone laterally across an upper portion of the fragmented permeable mass, such retort inlet mixture introduced at a sufficient temperature and rate to prevent thermal sloughing from above the top boundary into the inlet plenum void.

3. The method according to claim 2 wherein the retort inlet mixture comprises fuel and at least sufficient oxygen for combustion of the fuel for establishing a secondary combustion zone in an upper portion below the surface of the fragmented permeable mass.

4. The method according to claim 1 wherein during the second period of time the temperature in the inlet plenum void is increased a sufficient amount for causing sloughing from above the top boundary of the retort.

5. The method according to claim 4 wherein during the second period of time the temperature in the inlet plenum void is increased to at least about 300° F.

6. The method as claimed in claim 4 wherein during the second period of time the temperature is increased by reversing gas flow through the retort.

7. The method according to claim 4 wherein during the second period of time the temperature is increased by introducing a retort inlet mixture containing fuel and an oxygen supplying gas for establishing a secondary combustion zone in the inlet plenum void.

8. The method according to claim 1 wherein the second period of time begins after the completion of retorting.

9. A method for recovering liquid and gaseous products from an in situ oil shale retort in a subterranean formation containing oil shale, the retort having a top boundary of unfragmented formation and containing a fragmented permeable mass of formation particles containing oil shale comprising the steps of:

forming a fragmented permeable mass in the in situ oil shale retort wherein an upper surface of the fragmented permeable mass is separated from the top boundary of unfragmented formation by an inlet plenum void;

igniting oil shale in an upper portion of the fragmented permeable mass for establishing a primary combustion zone and a retorting zone;

introducing into the inlet plenum void a retort inlet mixture comprising fuel and at least sufficient oxygen for combustion of the fuel thereby establishing a secondary combustion zone in an upper portion of the fragmented mass for spreading the primary combustion zone laterally across the upper portion of the fragmented permeable mass;

for a first period of time maintaining the temperature in the inlet plenum void at less than the temperature at which unfragmented formation of the top boundary will slough into the inlet plenum void;

discontinuing the introduction of fuel while continuing introduction of oxygen supplying gas for sustaining the primary combustion zone and a retorting zone and for advancing the primary combustion zone and retorting zone through the fragmented permeable mass;

withdrawing liquid and gaseous products of retorting from a lower portion of the fragmented permeable mass on the advancing side of the retorting zone; and for a second period of time causing sloughing of unfragmented formation from above the top boundary into the inlet plenum void for substantially filling the inlet plenum void with fragmented mass.

10. The method according to claim 9 wherein for the first period of time the temperature in the inlet plenum void is maintained at less than the temperature at which unfragmented formation from above the top boundary will slough into the inlet plenum void by introducing the retort inlet mixture at a sufficient rate to maintain the secondary combustion zone below the upper surface of the fragmented permeable mass.

11. The method according to claim 9 wherein during the second period of time the temperature in the inlet plenum void is increased a sufficient amount for causing sloughing from above the top boundary of the retort.

12. The method according to claim 11 wherein during the second period of time the temperature in the inlet plenum void is increased to at least about 300° F.

13. The method according to claim 11 wherein during the second period of time the temperature is increased by reversing gas flow through the retort.

14. The method according to claim 11 wherein the second period of time begins after the completion of retorting.

15. A method for recovering liquid and gaseous products from an in situ oil shale retort in a subterranean formation containing oil shale, the retort having a top boundary of unfragmented formation and containing a fragmented permeable mass of formation particles containing oil shale comprising the steps of:

forming a fragmented permeable mass in the in situ oil shale retort wherein an upper surface of the fragmented permeable mass is separated from the top boundary of unfragmented formation by an inlet plenum void;

introducing into the inlet plenum void a retort inlet mixture comprising fuel and at least sufficient oxygen for oxidizing the fuel for establishing and propogating a combustion zone laterally across an upper portion of the fragmented permeable mass, the retort inlet mixture being introduced at a rate sufficient to maintain the combustion zone below the surface of the fragmented permeable means;

for a first period of time maintaining the temperature in the inlet plenum void at less than the temperature at which unfragmented formation from above the top boundary will slough into the inlet plenum void;

discontinuing the introduction of fuel while continuing introduction of oxygen supplying gas for sustaining a combustion zone and a retorting zone on the advancing side of the combustion zone and for advancing the primary combustion zone and retorting zone downwardly through the fragmented permeable mass;

withdrawing liquid and gaseous product of retorting from a lower portion of the fragmented permeable mass on the advancing side of the retorting zone; and for a second period of time causing sloughing of unfragmented formation from above the top boundary into the inlet plenum void.

16. The method according to claim 15 wherein during the second period of time sloughing is caused by increasing the temperature in the inlet plenum void.

17. The method according to claim 16 wherein during the second period of time temperature in the inlet plenum void is increased to at least about 300° F.

18. The method according to claim 16 wherein during the second period of time temperature is increased by reversing gas flow through the retort.

19. The method according to claim 15 wherein for the second period of time sloughing is continued until the inlet plenum void is substantially completely filled with fragmented mass.

20. The method according to claim 15 wherein the second period of time begins after the completion of retorting.

21. A method for recovering liquid and gaseous products from an in situ oil shale retort in a subterranean formation containing oil shale, the retort having a top boundary of unfragmented formation and containing a fragmented permeable mass of formation particles containing oil shale comprising the steps of:

forming a fragmented permeable mass in the in situ oil shale retort wherein substantially all of the top surface of the fragmented permeable mass is separated from the top boundary of unfragmented formation by an inlet plenum void;

introducing into the retort a retort inlet mixture comprising fuel and at least sufficient oxygen for oxidizing the fuel for establishing a secondary combustion zone for propagating a primary combustion zone laterally across an upper portion of the fragmented permeable mass, the retort inlet mixture introduced at a rate sufficient to prevent appreciable heating of the top boundary of unfragmented formation;

for a first period of time maintaining the temperature of the top boundary of unfragmented formation at less than the temperature at which unfragmented formation of the top boundary will slough into the inlet plenum void;

discontinuing the introduction of fuel while continuing the introduction of oxygen supplying gas for sustaining the primary combustion zone and a retorting zone and for advancing the primary combustion zone and retorting zone through the fragmented permeable mass;

withdrawing liquid and gaseous products of retorting from a lower portion of the fragmented permeable mass on the advancing side of the retorting zone; and for a second period of time increasing temperature in the inlet plenum void sufficiently for causing sloughing unfragmented formation from above the top boundary into the inlet plenum void.

22. The method according to claim 21 wherein for a first period of time the temperature in the inlet plenum void is maintained at less than the temperature at which unfragmented formation from above the top boundary will slough into the inlet plenum void by introducing the retort inlet mixture at a sufficient rate to maintain the secondary combustion zone below the top surface of the fragmented permeable mass.

23. The method according to claim 21 wherein during the second period of time temperature in the inlet plenum void is increased to at least about 300° F.

24. The method according to claim 21 wherein for the second period of time sloughing is continued until the inlet plenum void is substantially completely filled with fragmented mass.

25. The method according to claim 21 wherein the second period of time begins after the completion of retorting.

26. A method for retorting oil shale in an in situ oil shale retort in a subterranean formation containing oil shale, the retort having a top boundary of unfragmented formation and containing a fragmented permeable mass of formation particles wherein the upper surface of the fragmented permeable mass of formation particles is at least partly separated from the top boundary, the method comprising the steps of:

establishing a combustion zone in the fragmented permeable mass;

for a first period of time maintaining the temperature of the top boundary at less than the temperature at which unfragmented formation from above the top boundary will slough into the space between the upper surface of the fragmented permeable mass and the top boundary of unfragmented formation;

advancing the combustion zone downwardly through the retort; and for a second period of time causing sloughing of unfragmented formation from above the top boundary into the space between the top boundary and the upper surface of the fragmented permeable mass.

27. The method according to claim 26 wherein for the first period of time the temperature of the top boundary is maintained at less than about 300° F.

28. The method according to claim 26 wherein a fluid is introduced into the retort for advancing the combustion zone downwardly through the retort, such fluid introduced at a sufficient temperature and rate to maintain the temperature of the top boundary at less than about 300° F.

29. The method according to claim 26 wherein during the second period of time sloughing is caused by increasing the temperature of the top boundary of unfragmented formation.

30. The method according to claim 26 wherein for the second period of time sloughing is continued until a space between the upper surface of the fragmented permeable mass and the top boundary is substantially completely filled with fragmented mass.

31. The method according to claim 26 wherein the second period of time begins after the completion of retorting.

* * * * *

UNITED STATES PATENT AND TRADEMARK OFFICE

CERTIFICATE OF CORRECTION

PATENT NO. : 4,243,100

DATED : January 6, 1981

INVENTOR(S) : Chang Yul Cha

It is certified that error appears in the above—identified patent and that said Letters Patent is hereby corrected as shown below:

Col. 15, line 34, "868,924" should read -- 892,451 --; col. 15, lines 34-36, "METHOD FOR IGNITING AN IN SITU OIL SHALE RETORT HAVING A POCKET AT THE TOP" should read -- METHOD FOR ESTABLISHING A COMBUSTION ZONE IN AN IN SITU OIL SHALE RETORT HAVING A POCKET AT THE TOP --; col. 15, line 36, "Jan. 12" should read -- April 3 --; col. 15, line 37, "4,162,706" should read -- 4,192,552 --.

Signed and Sealed this

*Second* Day of *February 1982*

[SEAL]

*Attest:*

GERALD J. MOSSINGHOFF

*Attesting Officer*

*Commissioner of Patents and Trademarks*